US006827207B1

(12) United States Patent
Chen

(10) Patent No.: US 6,827,207 B1
(45) Date of Patent: Dec. 7, 2004

(54) BEVERAGE CONTAINER HOLDER

(76) Inventor: Chih-Chien Chen, No. 42, Lane 36, Guang Wu St., Shu Lin City, Taipei Hsien (TW)

( * ) Notice: Subject to any disclaimer, the term of this patent is extended or adjusted under 35 U.S.C. 154(b) by 18 days.

(21) Appl. No.: 10/455,364

(22) Filed: Jun. 6, 2003

(51) Int. Cl.[7] ..... B65D 75/00
(52) U.S. Cl. ..... 206/162; 206/549; 206/428
(58) Field of Search ..... 206/162, 141, 206/147, 153, 167, 169, 549, 428, 294

(56) References Cited

U.S. PATENT DOCUMENTS 4,793,647 A * 12/1988 Marvin ..... 294/87.2
5,642,808 A * 7/1997 Marco et al. ..... 206/150
5,738,217 A * 4/1998 Hunter ..... 206/549
5,803,264 A * 9/1998 Gersten et al. ..... 206/549
6,298,992 B1 * 10/2001 Tsao ..... 206/549

* cited by examiner

*Primary Examiner*—Jacob K. Ackun
*Assistant Examiner*—Bena B. Miller
(74) *Attorney, Agent, or Firm*—Troxell Law Office PLLC

(57) ABSTRACT

A beverage container holder includes a box portion integrally divided into a plurality of compartments for each holding a beverage container therein, and two generally U-shaped handles integrally extended from two opposite sides of the box portion and provided at predetermined positions with complementary studs and sockets. Each of the two handles defines an opening between the handle and the box portion, and a suspender is integrally connected to two near middle points of the handle to extend across the opening. When a desired number of beverage containers are positioned in the compartments of the box portion and the two handles are turned upward with the complementary studs and sockets engaged with one another, the suspenders are brought toward the box portion to stably confine the beverage containers thereto.

3 Claims, 5 Drawing Sheets

BEVERAGE CONTAINER HOLDER

FIELD OF THE INVENTION

The present invention relates to a beverage container holder, and more particularly to a beverage container holder provided with two suspenders integrally connected at two ends to two U-shaped handles via U-turn-shaped joints, so that the suspenders stably enclose beverage containers held in the beverage container holder when the handles are turned upward for carrying the beverage container holder.

BACKGROUND OF THE INVENTION

Beverage is an important part in many activities, including dinner parties, home parties, garden parties, and many other outdoor activities, such as hiking, camping, etc. In the early stage, beverage supplied in such activities was usually watered-down juice contained in a large barrel, tank or the like, and failed to meet the sanitary requirement. With the upgraded living standards in our daily life, people demand a much more strict sanitary requirement for water they drink. People now use water purified by means of reverse osmosis to prepare many differently flavored drinks and package the prepared drinks with individually film-sealed plastic cups or containers.

Most of the containers currently used to package the prepared drinks have a downward tapered body. This type of beverage container tends to tilt over in a poly bag or carrier bag holding them and therefore causes inconveniences to consumers. A common way to get the downward tapered beverage containers stably located in a soft poly bag or carrier bag is to pad a bottom of the poly bag or carrier bag with a pre-cut cardboard and then position or stack the beverage containers on the cardboard in the bag, so that the beverage containers are stably supported on the cardboard without easily tilting over.

There is also provided a box integrally divided into several compartments, each of which may have a beverage cup or container fitly and stably received therein.

All the above-mentioned conventional ways for stably holding beverage cups or containers involve in time-consuming packaging. Moreover, the boxes, the bags, or the cardboards have to be separately stored to result in inconveniences in management thereof.

It is therefore tried by the inventor to develop a beverage container holder to eliminate the drawbacks existed in the prior art.

SUMMARY OF THE INVENTION

A primary object of the present invention is to provide a beverage container holder that can be conveniently stored without occupying too much space and enables stable holding and carrying of a number of beverage containers at a time.

To achieve the above and other objects, the beverage container holder of the present invention mainly includes a box portion divided into a plurality of compartments for each holding a beverage container therein, and two generally U-shaped handles integrally extended from two opposite sides of the box portion and provided at predetermined positions with fastening means, such as complementary studs and sockets. Each of the two handles defines an opening between the handle and the box portion, and a suspender is integrally connected to and extended across two near middle points of the handle. The suspender is a substantially U-shaped integral member being formed by cutting at the time of forming the opening between the handle and the box portion. A joint of each end of the suspender and the handle is made like a U-turn, so that the suspender is substantially pivotally turnable about the U-turn joints relative to the handle. When a desired number of beverage containers are positioned in the compartments of the box portion and the two handles are turned upward with the complementary fastening means engaged with one another, the beverage containers are stably confined to the box portion by the suspenders that fitly enclose the beverage containers.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
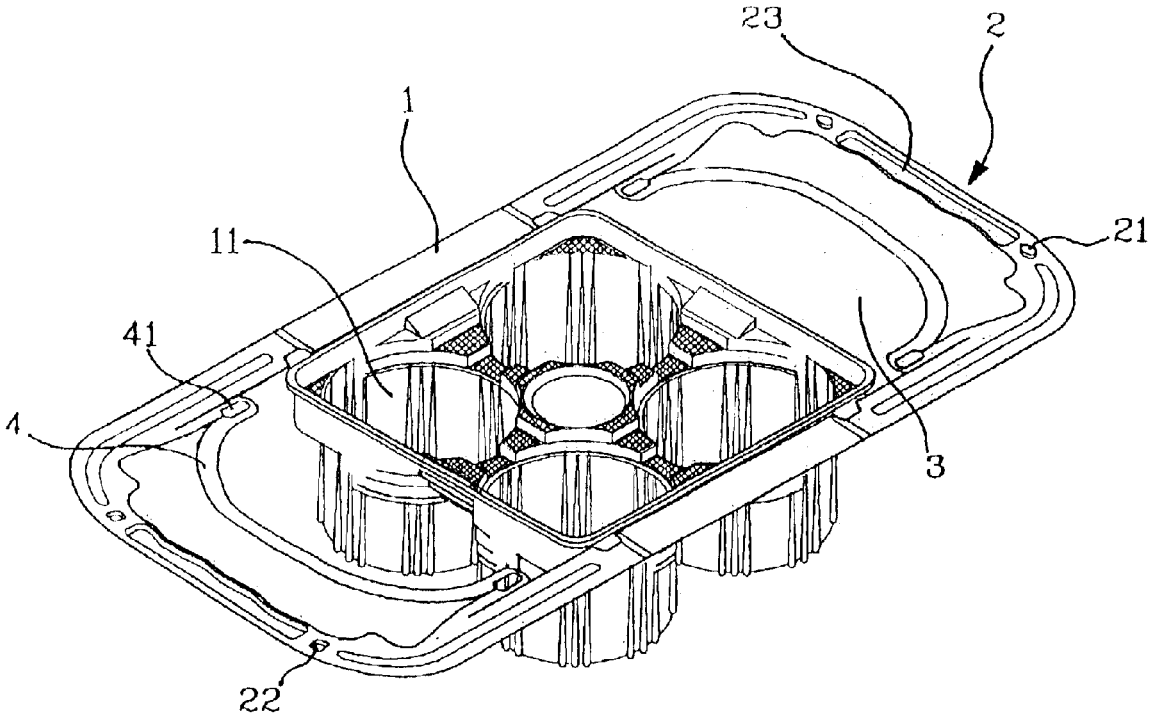
FIG. 1 is a perspective view of a beverage container holder according to the present invention.
Figure 2:
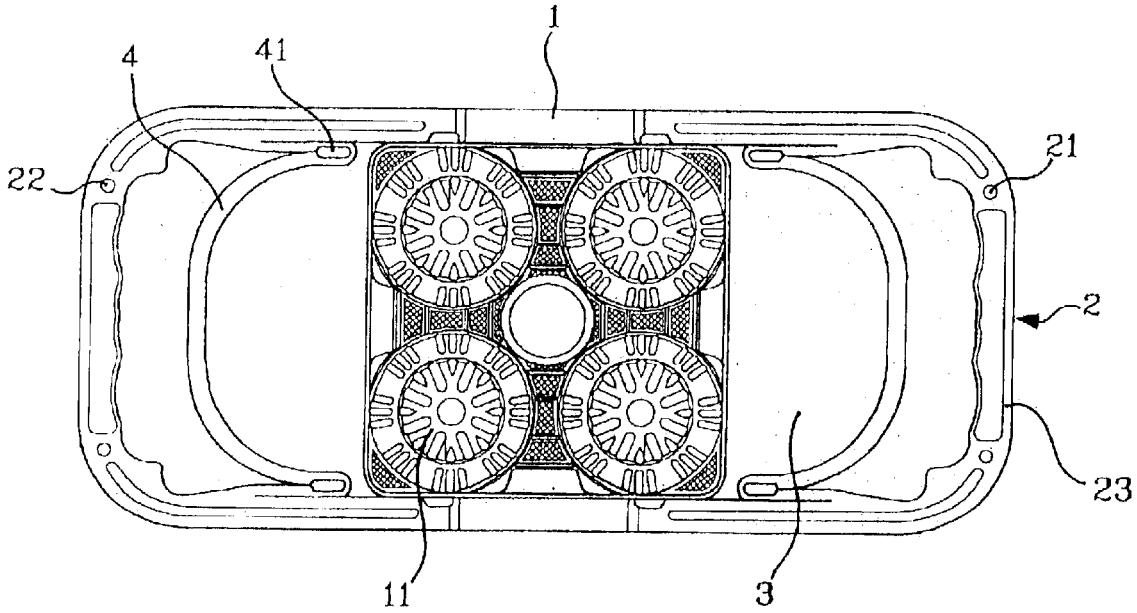
FIG. 2 is a top plan view of FIG. 1.

Please refer to FIGS. 1 and 2 that are perspective and top plan views, respectively, of a beverage container holder according to an embodiment of the present invention. As shown, the beverage container holder mainly includes a box portion 1 integrally molded from a thin plastic sheet, and two U-shaped handles 2 integrally extended from two opposite sides of the box portion 1. The box portion 1 is divided into two or more round-sectioned compartments 11, into each of which a general beverage container may be positioned. Each of the U-shaped handles 2 includes a crossbar portion 23 extended between two arm portions. The two handles 2 are provided at predetermined positions with complementary fastening means, such as studs 21 provided on one of the two handles 2, and sockets 22 correspondingly provided on the other handle 2 for fitly engaging with the studs 21. When the beverage container holder is initially molded, the two U-shaped handles 2 are flatly stretched at two opposite sides of the box portion 1 to define an opening 3 between the box portion 1 and each of the handles 2. The handle 2 is characterized in an integrally formed suspender 4, two ends of which are integrally connected to two near middle points of the two arm portions of the U-shaped handle 2. The suspender 4 is a substantially U-shaped member and may be formed by, for example, cutting at the time of forming the opening 3. A joint of each end of the suspender 4 and the arm portion of the handle 2 is made like a U-turn 41, so that the suspender 4 is substantially pivotally turnable about the U-turn joints 41 relative to the handle 2.

The number of the compartments 11 provided on the box portion 1 may be changed depending on actual need. For example, two, four, or six compartments 11 maybe formed. In the illustrated embodiment, four compartments 11 are formed on the box portion 1. And, the studs 21 and the sockets 22 are preferably provided on the crossbars portion 23 of the two U-shaped handles 2.

Figure 3:
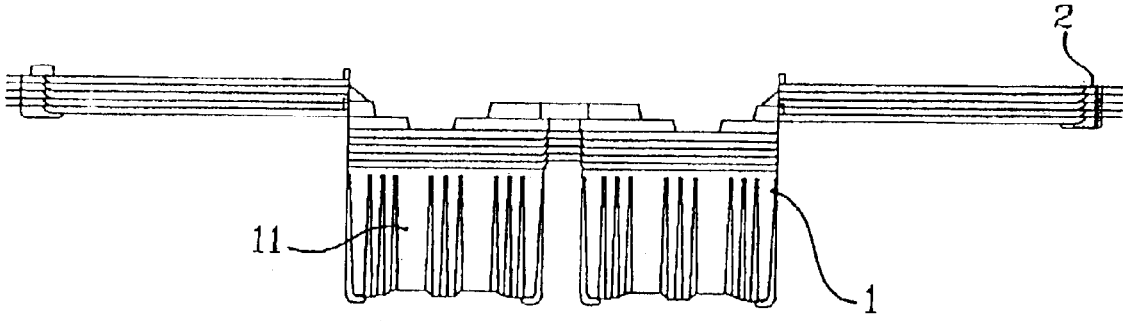
FIG. 3 shows a plurality of the beverage container holders of FIG. 1 may be nested for convenient storage.

With the above arrangements, the beverage container holder of the present invention before use has two handles 2 flatly extended in two opposite directions. Therefore, a plurality of the beverage container holders of the present invention may be sequentially nested at the box portion 1 to occupy only a very small space, as shown in FIG. 3.

Figure 4:
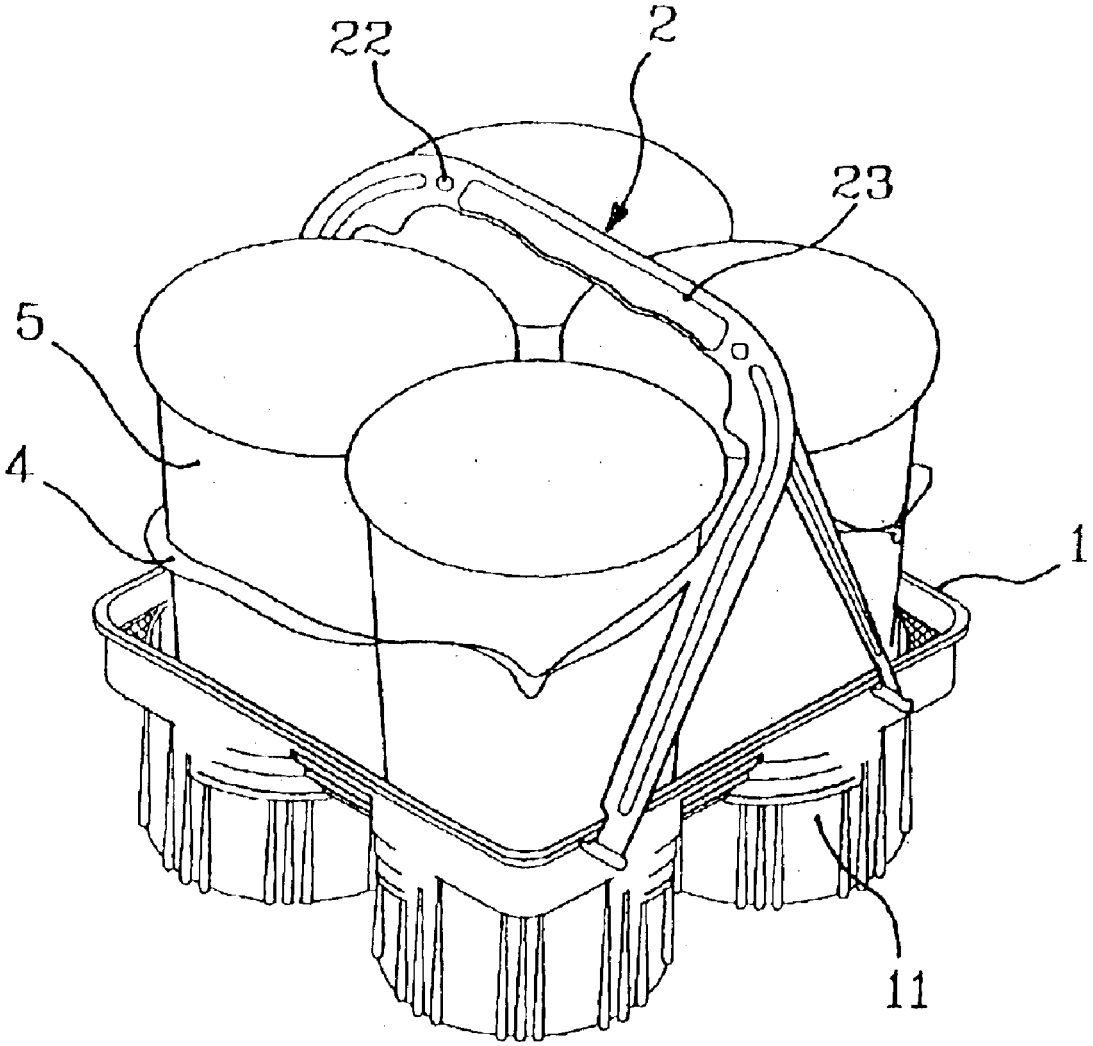
FIG. 4 is a perspective view of the beverage container holder of FIG. 1 in use.
Figure 5:
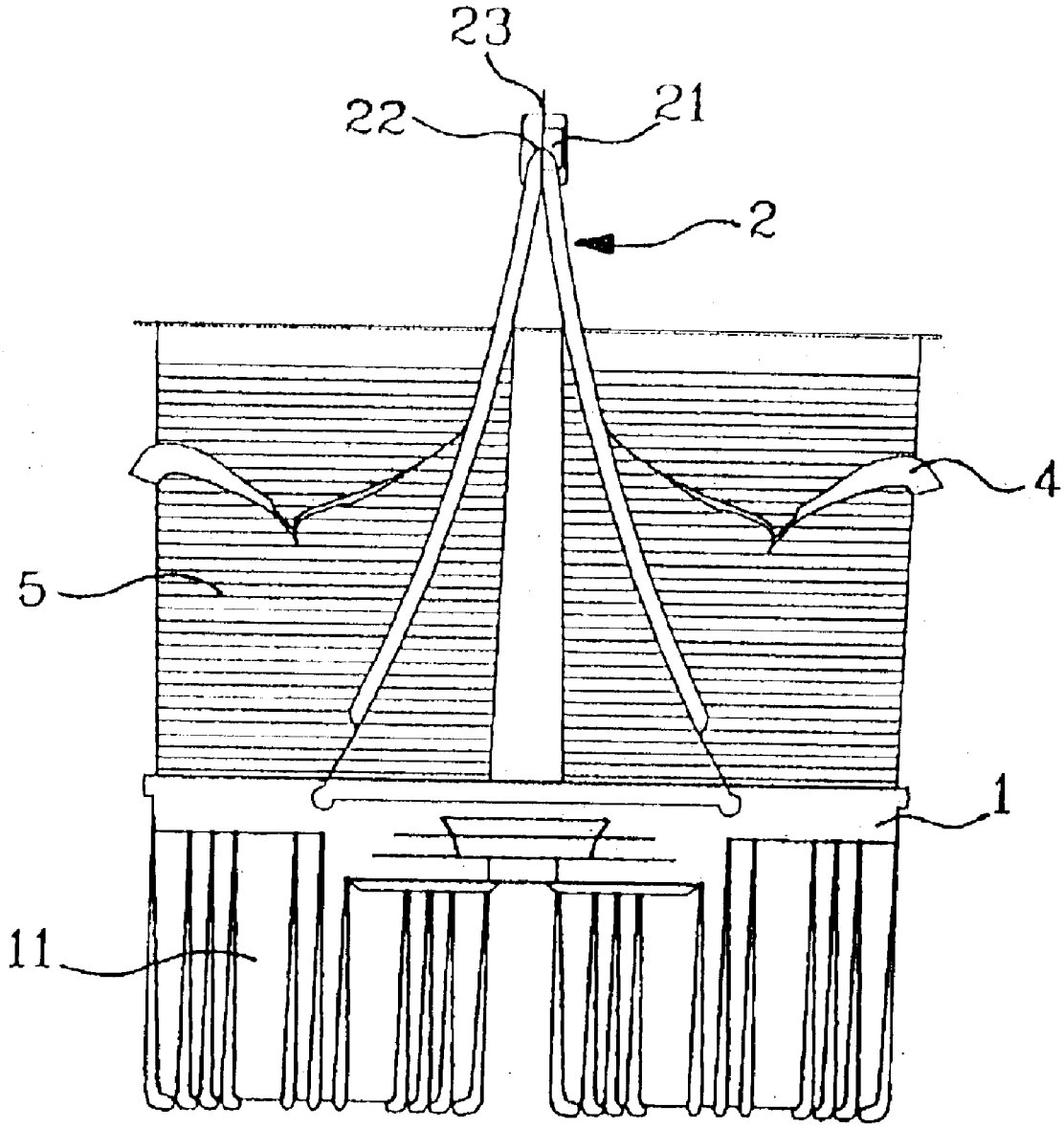
FIG. 5 is a side view of FIG. 4.

To use the beverage container holder of the present invention, simply separately position a desired number of beverage containers 5 in the compartments 11 on the box portion 1, and then turn the two U-shaped handles 2 from the flatly stretched position to an upward position, and engage the studs 21 with the sockets 22 on the two handles 2 to provide a grip at the crossbar portions 23. When the handles 2 are turned upward, the two suspenders 4 are also brought toward the box portion 1 to finally contact with outer wall surfaces of the beverage containers 5 positioned in the compartments 11. The U-turn joints 41 allow the suspenders 4 to pivotally turn to a position for fitly and stably confining the beverage containers 5 to the box portion 1 without the risk of easily tilting over, as shown in FIGS. 4 and 5.

The present invention has been described with a preferred embodiment thereof and it is understood that many changes and modifications in the described embodiment can be carried out without departing from the scope and the spirit of the invention as defined by the appended claims.

What is claimed is:

1. A beverage container holder, comprising a box portion integrally divided into a plurality of compartments for each holding a beverage container therein, and two generally U-shaped handles integrally extended from two opposite sides of said box portion and provided at predetermined positions with complementary fastening means; and each of said two handles including a crossbar portion and two arm portions to define an opening between said handle and said box portion, and a suspender being integrally connected at two ends to two near middle points of said two arm portions of said U-shaped handle to extend across said opening; whereby when a desired number of said beverage containers are separately positioned in said compartments on said box portion and said two handles are turned upward with the complementary fastening means engaged with one another, said suspenders are brought toward said box portion to fitly contact with and thereby stably confine said beverage containers to said box portion.

2. The beverage container holder as claimed in claim 1, wherein said complementary fastening means are studs and corresponding sockets separately provided on said crossbar portions of said two handles.

3. The beverage container holder as claimed in claim 1, wherein each of said suspenders is a substantially U-shaped integral member being formed by cutting at the time of forming said opening between said handle and said box portion; and a joint of each end of said suspender and said arm portion of said handle being made like a U-turn, so that said suspender is substantially pivotally turnable about said U-turn joints relative to said handle.

* * * * *